US006176229B1

(12) United States Patent
Patenaude

(10) Patent No.: US 6,176,229 B1
(45) Date of Patent: Jan. 23, 2001

(54) DOUBLES FINGER FOR PROPELLING TWO CLAY TARGETS

(76) Inventor: Stuart W. Patenaude, 16 Colby Hill Rd., Henniker, NH (US) 03242

( * ) Notice: Under 35 U.S.C. 154(b), the term of this patent shall be extended for 0 days.

(21) Appl. No.: 08/946,394

(22) Filed: Oct. 7, 1997

(51) Int. Cl.[7] ..... F41J 9/18
(52) U.S. Cl. ..... 124/8
(58) Field of Search ..... 124/6, 7, 8, 9, 124/46, 47

(56) References Cited

U.S. PATENT DOCUMENTS

| | | | | |
|---|---|---|---|---|
| 2,171,623 | * | 9/1939 | Connell | 124/8 |
| 2,934,056 | * | 4/1960 | Lauterbach | 124/9 |
| 3,923,033 | * | 12/1975 | Laporte et al. | 124/8 |
| 5,249,563 | * | 10/1993 | Patenaude | 124/8 |
| 5,406,928 | * | 4/1995 | Panara et al. | 124/8 |

FOREIGN PATENT DOCUMENTS

| | | | | |
|---|---|---|---|---|
| 1951111 | * | 4/1970 | (DE) | 124/8 |
| 536281 | * | 11/1955 | (IT) | 124/8 |

* cited by examiner

*Primary Examiner*—John A. Ricci
(74) *Attorney, Agent, or Firm*—George W. Dishong

(57) ABSTRACT

An improved doubles finger, for use in doubles clay target trap machines. The improved doubles finger has a length and shape which is configured to cause a first and a second target each to have a preferred optimum, consistent, reproducible and desirable first target trajectory, second target trajectory, first target velocity and second target velocity. The doubles finger has a target guide portion having an arcuate target contacting and guiding edge. When the doubles finger is assembled onto the trap machine, the contacting and guiding edge is positioned to contact a second clay target, i.e., the outermost clay target of the two clay targets while the second clay target is being launched by the doubles throwing trap machine. The arcuate target contacting and guiding edge has a defined and predetermined length and a radius of curvature which causes the first and second clay targets each to have a trajectory which does not tail-off and causes a separation of the trajectories which is deemed most desireable and optimum by the shooters. The trajectories are, consistent, reproducible and desirable.

19 Claims, 11 Drawing Sheets

DOUBLES FINGER FOR PROPELLING TWO CLAY TARGETS

BACKGROUND OF THE INVENTION

1. Field of the Invention

This invention most generally relates to clay target/pigeon throwing machines used in the activity of sport shooting or trap shooting. More particularly, the invention relates to a means or apparatus—trap machine for the automatic setting of one clay target or the automatic setting, if so chosen, of two clay targets. Clay target throwing machines generally are used in either the singles mode or the doubles mode of operation and on signal, propel throw or launch one clay target or two clay targets on a trajectory or trajectories into a target zone in either constant trajectories for each of the two targets or, if so selected by the user of the machine, in random first and second trajectories respectively for each of the first and second targets. The machines are sometimes referred to as trap machines. The clay targets are circular and somewhat disc shaped. More particularly, the clay target throwing machine in which the present invention may be used, is adapted to optionally and automatically throw, simultaneously, two (2) targets. When the machine is operated in either the singles or the doubles mode, the machine may be designed so that optionally, each successive target or double targets which are thrown are directed in a direction which is randomly generated so that the target direction is not predictable by the shooter as he/she is triggering the throw of the target by the machine. Additionally, a plurality of targets may be loaded into an indexing carousel which automatically indexes either one or two of the targets to the load position and stays in position while an "elevator" lowers the target or targets into the so-called launch, firing or throwing position. When in the dual or doubles throw mode, a device is provided which positions each of the clay targets one relative to the other to get consistent throws and to reduce breakage while the targets are being propelled by the throwing arm of the machine. A so-called "finger" or "doubles finger" is quite often used as the device which guides targets as they are launched by the fling arm. The present invention is an improved doubles finger for guiding targets. The trap machine is operated by one bidirectional hydraulic motor which provides the indexing and the power to, in effect load the spring that provides the energy to the throwing arm to propel the target or targets. A specially designed hydraulic piston assembly provides for the dampening of oscillations of the carousel when the carousel and the throwing assembly randomly position prior to the throwing of the target. The elevation angle of the target trajectory is adjustable with a cam and latching assembly.

More particularly the improved doubles finger invention is designed to cause an outermost target, when operating in the double throwing mode, to travel in a consistent, accurately reproducible trajectory. The improvement most particularly relates to the doubles finger that aligns and directs the target or targets when they are launched or thrown.

There are doubles fingers in present clay target throwing machines, however, the trajectory of the targets is not the most desireable trajectory. That is to say, the shooters do not particularly like the separation between the trajectories of the two targets. Further, there is considerable "tail-off" of the targets. I.e., the targets curve in the flight path. The target separation and the target trajectories are significantly improved with the use of the doubles finger of the present invention. With the doubles finger of the present invention, clay targets may be thrown with an optimum, consistent, reproducible and desirable first target trajectory, second target trajectory, first target velocity and second target velocity.

Most particularly this invention relates to an improved doubles finger which is mounted onto a doubles trap machine and which causes the outer-most clay target to have a trajectory and a velocity (trajectory and velocity being referred to as the clay target flight characteristics) which is more optimum and desirable relative to the flight characteristics of clay targets launched by doubles trap machines presently known and used. The improved doubles finger aligns and directs the target or targets when thrown. The improved doubles finger, when incorporated into or onto any or all known doubles trap machines, would result in such improved trajectories. Representative of such doubles trap machines is the machine defined and claimed in Applicant's U.S. Pat. No. 5,249,563, Issued on Oct. 5, 1993, which patent is incorporated herein by reference. Applicant's patented doubles trap machine is used to characterize and to explain the present invention—the improved doubles finger.

2. Description of the Prior Art

Presently there is nothing available of which Applicant herein is aware, that is reasonable in cost and simple to use and, very importantly, that can be used to "set" doubles, and does not require a loader/human being to be in the trap house.

Some inventions related to the instant invention and disclosed in the following United States Patents have been studied. The following is a brief description and discussion of the most relevant of these related inventions.

Cote et al U.S. Pat. No. 4,706,641 teaches an automatic clay target feeder attachment that can be attached to a clay target trap machine that will self-load without the need of manual assistance. It can be selectively set (by the flip of a switch which controls an adjustable time delay relay) to drop one or two targets onto the flinger arm. Note that both targets are apparently dropped from the same source position on to the flinger arm. There is also a means provided for properly positioning the two targets on the flinger arm preparatory to the shooting of the two targets. Cote et al does not teach a lowering mechanism or elevator, nor an indexing carousel, nor the placing of two targets onto the flinger arm, or into a set position preparatory to launch, through different apertures, nor does he teach the random direction feature of the instant invention. The Cote et al device requires too much time between launching and reload and subsequent launch of targets. Further the device holds too few targets for use in competitive situations.

Alday et al, U.S. Pat. No. 4,005,695 clearly teaches autoloading and autoangling of targets and a device which automatically varies the direction a target is thrown. There is also a revolving magazine having a number of stacks of targets independently and fixedly supported relative to an oscillating target throwing housing. A primary feature of this invention is the power train consisting of three equal sized gears mounted on three parallel shafts to throw the targets and to oscillate the housing. Here again the invention disclosed in the present application for patent does not include all of the elements of Alday et al and by not including those features and/or elements taught and claimed by Alday et al, and what Alday et al considers and teaches as necessary elements, obtains advantages over Alday et al. The instant invention is clearly an unobvious variation and advancement over Alday et al. What is more important is that the combined teaching of, Cote et al, and Alday et al would not lead one to design the instantly disclosed invention. In addition none of the prior art teaches the "elevator" principle of the trap machine as taught and claimed herein.

Leichner, U.S. Pat. No. 3,244,132 again teaches a mechanism for throwing clay targets which is suitable for automatic operation. There is also taught an automatic operation by a fluid actuation system. The drawings show an indexing carousel. There is also a means for changing the angle of inclination of the gearing arrangement and thereby the angle of inclination of the throwing arm so that the trajectory of the target may be adjusted. The additional feature taught and claimed by Leichner is the hydraulic and/or pneumatic drive system.

The Patents all appear to be variations of means for throwing clay targets including the automatic loading thereof. Cote et al teaches the automatic loading and throwing of two targets or one target. Alday et al, teaches autoloading and autoangling which automatically varies the direction a target is thrown. Leichner teaches a mechanism for throwing clay targets which is suitable for automatic operation. There is also taught an automatic operation by a fluid actuation system and an indexing carousel.

However, none of the prior art with which Applicant is familiar teaches what Applicant herein teaches and claims as his invention. The improved doubles finger having a longer finger length, an optionally radiused clay target contacting and guiding edge and an optional means for imparting enhanced rotational motion to a clay target contacting the clay target contacting and guiding edge provides performance advantages over any of the known trap machines which throw two clay targets. The improved doubles finger of the present invention may be used with any doubles throwing trap machine which has a finger which is replaceable by the improved finger. I.e., clearly, the improved finger need not be used only with Applicant's patented trap machine.

Applicant's patented trap machine is the only one which throws both singles and doubles properly and quickly enough for trap competition shooting. The two targets are lowered and set at the same time. The throw arm or fling-arm has substantially two functions—it repeatably, carefully and accurately sets or positions the targets into the proper launch position, and it launches either one or both targets simultaneously. The fling-arm is reversed in direction after it has launched targets and then it is moved slowly forward positioning the two targets relative to each other and relative to and properly against and in front of the fling-arm; i.e., into the launch position for subsequent launching. Additionally, a means is provided for lowering, as by an elevator device for example, either the one target when the machine is throwing singles, or both targets when throwing doubles, into the setting position from which position the machine then sets the targets into the launch position. Applicant's patented machine can be changed from throwing singles to throwing doubles by simply "flipping over" a doubles roller or what is called the lower roller in Installation Instructions for the PAT-TRAP™ brand of trap machine. The energy stored in the fling-arm spring is increased when operating in the doubles throwing mode in the manner detailed in the installation instructions. Usually in the doubles mode the machine is set to throw the doubles in substantially the same first and second target trajectories. However; it is possible to operate the machine in the oscillation or random trajectory mode even when throwing doubles. In order to reduce vibrations in the oscillation mode, there is provided a hydraulic piston arrangement which is normally on (handle down) for singles and is normally off (handle up) for doubles. The handle in the up position turns off or disables the means for providing oscillation and consequent random trajectories. Reference is again made to the Installation Instructions.

Applicant herein is not aware of any doubles finger which, when used with an appropriately designed doubles throwing trap machine, provides the consistent and desireable clay target trajectories and velocities which are obtained when using the disclosed doubles finger of the present invention.

SUMMARY OF THE INVENTION

The present invention is an improved doubles throwing finger, for use with clay target throwing machines. The improved doubles finger (sometimes referred to as simply "finger") has a length and shape which is configured to cause a first and a second target each to have a preferred optimum, consistent, reproducible and desirable first target trajectory, second target trajectory, first target velocity and second target velocity. The doubles finger has a target guide portion having a target contacting and guiding edge which edge may optionally have a radius of curvature. When the doubles finger is assembled onto the trap machine, the contacting and guiding edge is positioned to contact a second clay target, i.e., the outermost clay target of the two clay targets while the second clay target is being launched by the doubles throwing trap machine. The target contacting and guiding edge has a defined and predetermined length and a radius of curvature which causes the first and second clay targets each to have a trajectory which does not tail-off and causes a separation of the trajectories which is deemed most desireable and optimum by the shooters. The trajectories are, consistent, reproducible and desirable. The target contacting and guiding edge of the doubles finger, if arcuate and optionally radiused, has an arc having a length and a radius of curvature preferably about equal to the radius of curvature of the end of the fling arm; i.e., the end most distant from the center of the fling arm. The arcuate target contacting and guiding edge has a length dimension which is sufficiently long compared to the contact length of presently used fingers to result in the enhanced performance and flight characteristics provided by the improved doubles finger. There may also be provided various optional means for imparting enhanced rotational motion to a clay target which is contacting the clay target contacting and guiding edge which optional means provides performance advantages over any of the known trap machines which throw two clay targets. For example the guiding edge may be made more or less frictionous to the portion of the clay target with which it is in contact. This frictionous guiding edge will add an increased clay target angular rotation velocity which, like a baseball, will affect the flight path or trajectory of the target. The doubles finger also has a means for attaching the finger to a trap machine.

A primary object of the invention is to provide an improved target throwing doubles finger with a total length dimension which may be between about 5–12 inches but which length depends upon the physical size of the doubles trap machine with which the improved doubles finger is used and which has a target trajectory guiding edge, for use with a clay target throwing machine throwing one or two targets. The target throwing machine has a means for holding and for delivering a first clay target to a position for subsequent setting, means for setting the first target into a position for launching, means for launching by a cocked fling-arm the first target into a target area, means for selecting constant and random first trajectories of the launched first target into the target area and means for switchably providing power, upon occurrence of a signal, to the means for holding and delivering of the first target and cocking the fling-arm.

Another object of the invention is to provide, with the improved finger of the present invention, means for selectively delivering two targets simultaneously, a first target to a first target set position and a second target to a second target set position and means for setting and holding, prior to launching of both the targets when the two target delivery is selected, both the first and second targets in a first and second launch position. The both launch positions relate to each other so as to reduce target breakage and are in space relation to the fling-arm for proper launching of the first target into the first target trajectory and simultaneously launching the second target into a second target trajectory.

A further object of the invention is to provide a doubles finger for use in a clay target throwing machine or trap machine comprising; means for attaching the doubles finger to the clay target throwing machine; a target guide portion contiguous with the means for attaching, the target guide portion having an arcuate target contacting and guiding edge positioned to contact a second clay target of two clay targets while the second clay target is being launched by the clay target throwing machine when the doubles finger is assembled onto the clay target throwing machine; and the arcuate target contacting and guiding edge having a defined and predetermined length.

A further object of the invention is to provide the doubles finger wherein the curvature of the arcuate target contacting and guiding edge of the doubles finger is chosen to give a desired first target trajectory, second target trajectory, first target velocity and second target velocity.

Still another object is to provide an doubles finger wherein the curvature of the arcuate target contacting and guiding edge is about equal to the curvature of an arc formed by a curved path made by a fling-arm of a clay target throwing machine as the fling-arm launches a first and second clay target.

Another object is to provide the doubles finger wherein the length of each target contacting and guiding edge is chosen to yield a desired first target trajectory, second target trajectory, first target velocity and second target velocity, the target flight characteristics being related to the length and the curvature of the target contacting and guiding edge.

Yet another object is to provide the doubles finger further comprising a means for imparting enhanced rotational motion to a first clay target and a second clay target.

A further object is to provide the doubles finger wherein the means for imparting enhanced rotational motion comprises serations cut along the target contacting and guiding edge, a variation of the slope of target contacting and guiding edge relative to a flat upper surface and a flat lower surface of said doubles finger, or even a frictionous material secured along at least a portion of the length of the target contacting and guiding edge.

These and further objects of the present invention will become apparent to those skilled in the art after a study of the present disclosure of the invention.

DESCRIPTION OF THE PREFERRED EMBODIMENTS

Figure 1:
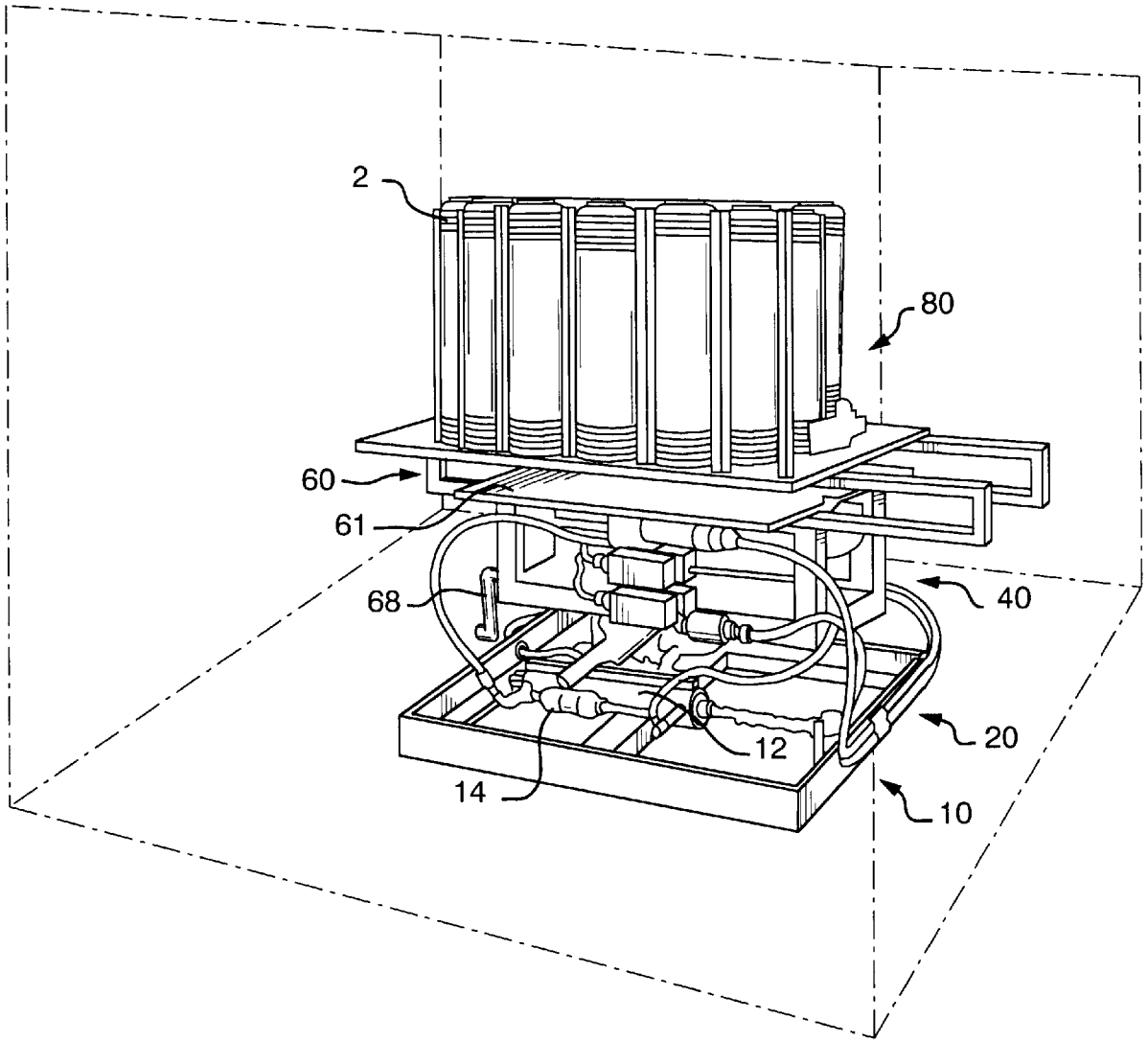
FIG. 1 is a pictorial perspective illustration of the trap machine illustrating positioning of the machine within a trap house.

The following is a description of the preferred embodiment of the invention. In order to fully and completely disclose the features and the advantages of the invention, Applicant makes a part hereof, and hereby incorporates by reference, the U.S. Pat. No. 5,249,563, for the preferred embodiment of a target throwing machine into which the present, improved doubles throwing finger may be incorporated. Clearly, Applicant cannot disclose all of the many mechanical variations which may be used to perform each of the functions which are incorporated into trap machines with throwing fingers. Electrical energy using electric motors could well be used to provide the rotational energy and the energy for storage in the fling-arm spring. A gasoline engine could be used to provide the basic power and energy to the hydraulic pump which provides the means to power the machine of the preferred embodiment. There are certainly choices relative to the materials used in the construction of the machine as well as in the choice of the electrical components which are used to effect the actuation and the proper sequencing of the functions of the machine. Instead of mechanical contacting types of electrical switches magnetic proximity switches could easily be used. The turret or carousel which holds the clay targets and which is driven in an indexing fashion to deliver either a first target only when in the singles mode or two targets, a first and a second target simultaneously to a position where they are then lowered to a setting position, may be made of various metals, plastics and alloys. The material choice is obviously a function of, among other factors, appropriate strength, case of working, availability and cost. Similar comments are true for the other remaining fundamental components or assemblies which, in combination, comprise the apparatus of the present invention i.e., the instant trap machine.

It is obvious to one of ordinary skill, that the dimensions which may be implied from the drawing figures may be varied to accommodate any number of applications. The clay targets have a diameter of 4¼ inches, total height of 1 1/16 inches and weigh 3½ ounces. These are standard dimensions for clay targets and are common knowledge to all who are involved in the sport of or the business of trap shooting. It is obvious from the scaled and to scale drawings provided herewith, and given the known dimensions of the targets, what the dimensions are for the many various components and elements which make up the preferred embodiment of the trap machine and improved doubles throwing finger. Thus dimensions for some of the various components are not provided. It is obvious that the machine could be scaled up or down in order to increase the number of targets which could be effectively handled and launched.

Reference is now made to the drawing figures included herewith and made a part hereof. The drawings are referred to as a collection of drawings all of which, when taken as a collection, fully disclose the preferred embodiment of the improved doubles finger invention herein claimed. Applicant has included herewith a detailed explanation of the use of Applicant's patented machine only for the purpose of showing the manner of application of the improved doubles finger as it is incorporated into the patented doubles machine. The invention—the improved doubles finger—when incorporated into this machine or a similar type machine substantially improves the performance of the machines as it relates to the doubles target trajectories.

The clay target throwing machine or trap machine of the present invention 10 is made up of essentially four (4) basic assemblies; a base assembly 20 which is substantial stationary relative the surface upon which the machine rests (usually on the floor of a so-called trap house); power system control assembly 40 tiltably, rotationally and oscillatorially interconnected to the base assembly 20; a target positioning and launching assembly 60 rigidly and functionally connected to the power system control assembly 40 and a target holding and transporting or delivering assembly 80 for holding a plurality of clay targets 2 and delivering either one, a first clay target 2A to a position 72 for subsequent setting to set position 72A, or two clay targets—a first target 2A and a second target 2B simultaneously into position 72 and 74 for simultaneously setting of both targets to set positions 72A and 74A. As fling-arm 66 is caused to rotate, targets 2A and 2B move into launch positions 72B and 74B on launch plate 61 of launching assembly 60. The holding and delivering assembly 80 is preferably made up of a turret or carousel 90 which rotationally indexes relative to the target positioning and launching assembly 60, on signal, appropriately moving either one or two targets 2 into position 72 or 72 and 74 for subsequent setting and positioning for launch.

Figure 2:
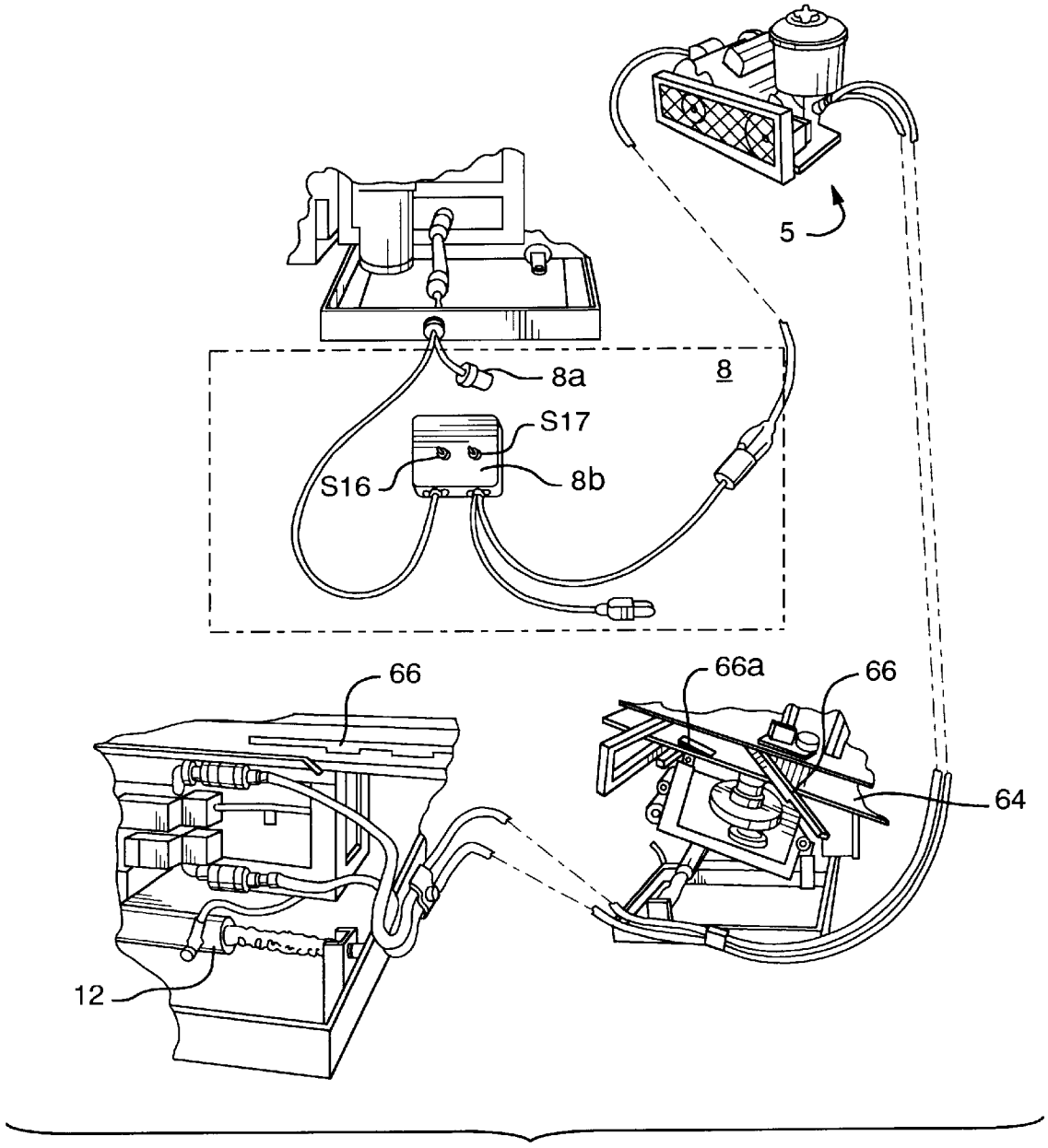
FIG. 2 is a pictorial illustration of the machine in association with a pump which provides the hydraulic pressure for operation of the machine, a control assembly illustrating how the operator controls the functions of machine and the hydraulic line assembly and connections.
Figure 3A:
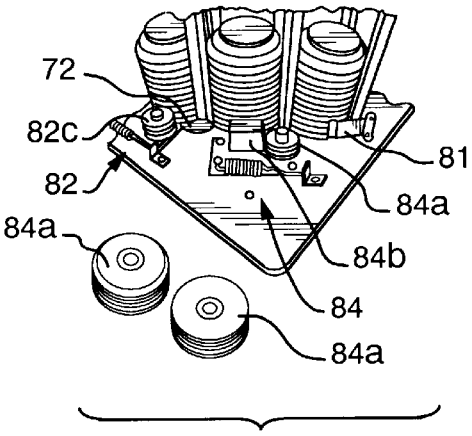
FIGS. 3A–3D is a pictorial illustration of the trap machine illustrating several sections of the machine in an exploded view to better illustrate some of the features and adjustments associated with the machine.
Figure 3B:
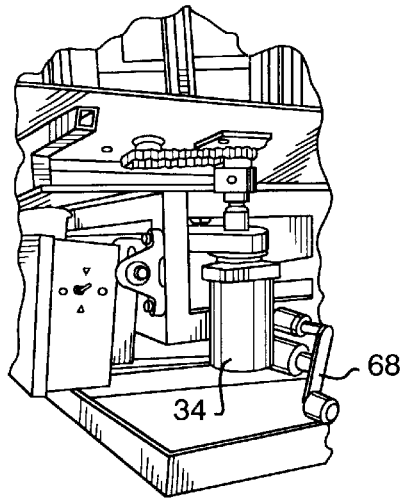
Figure 3:
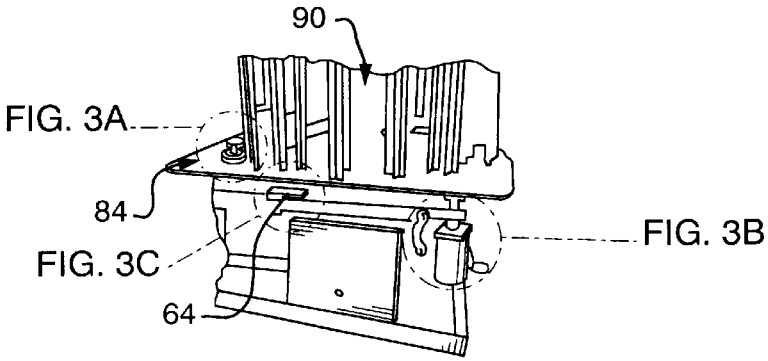
Figure 3C:
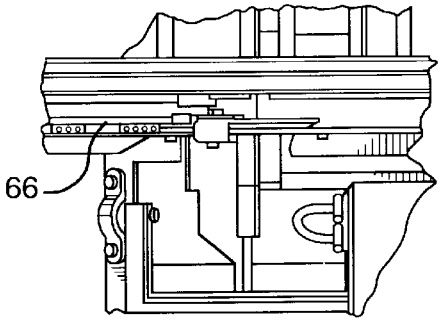
Figure 3D:
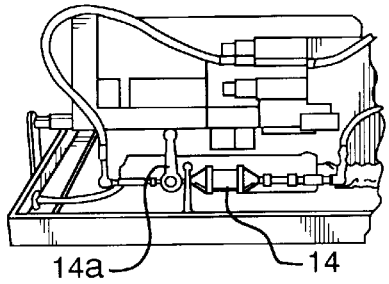
Figure 4:
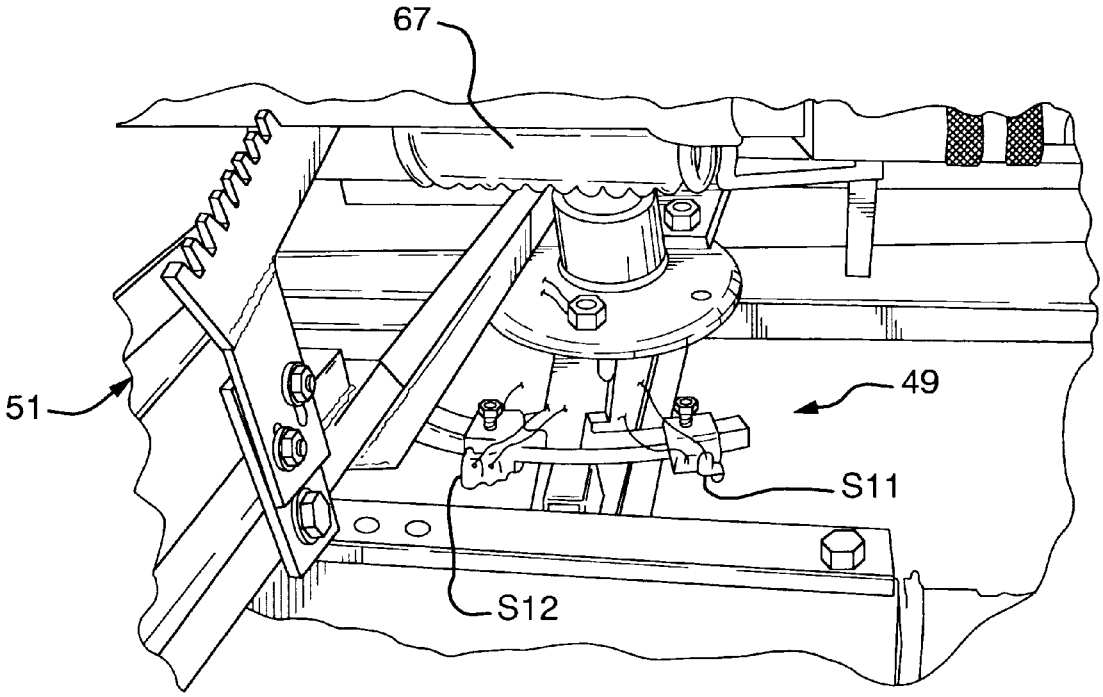
FIG. 4 is a pictorial illustration of the section of the machine which relates to the adjustment of the trajectories of the launched targets and the adjustment of the excursion of the side-to-side oscillation which causes randomness of direction of the trajectories of launched or thrown targets whether doubles or singles are being thrown.
Figure 5:
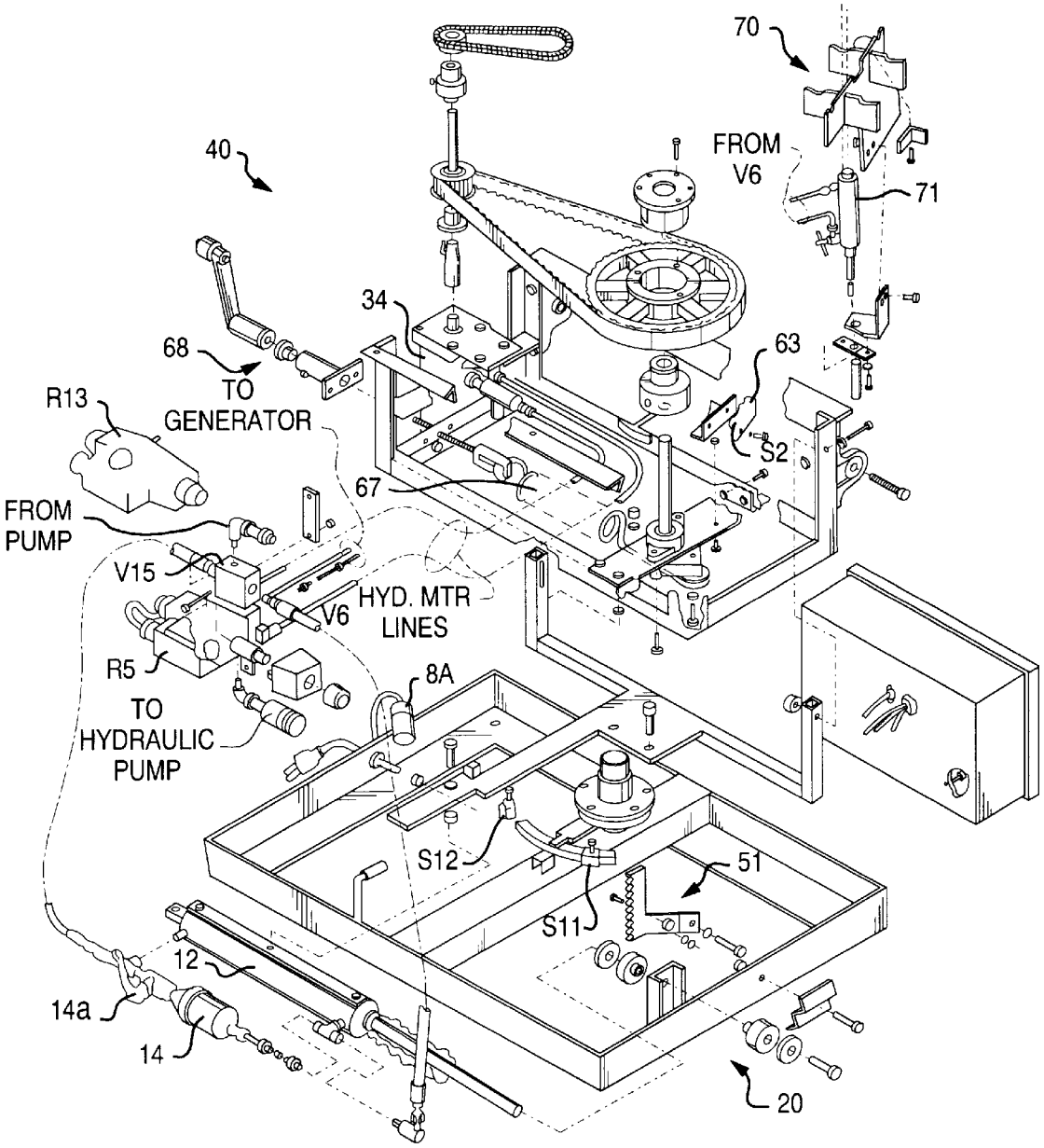
FIG. 5 is a mechanical drawing of the base portion or assembly and the power system control assembly tiltably, rotationally and oscillatorially interconnected to the base assembly of the machine with all of the major components and subassemblies in exploded view.
Figure 6:
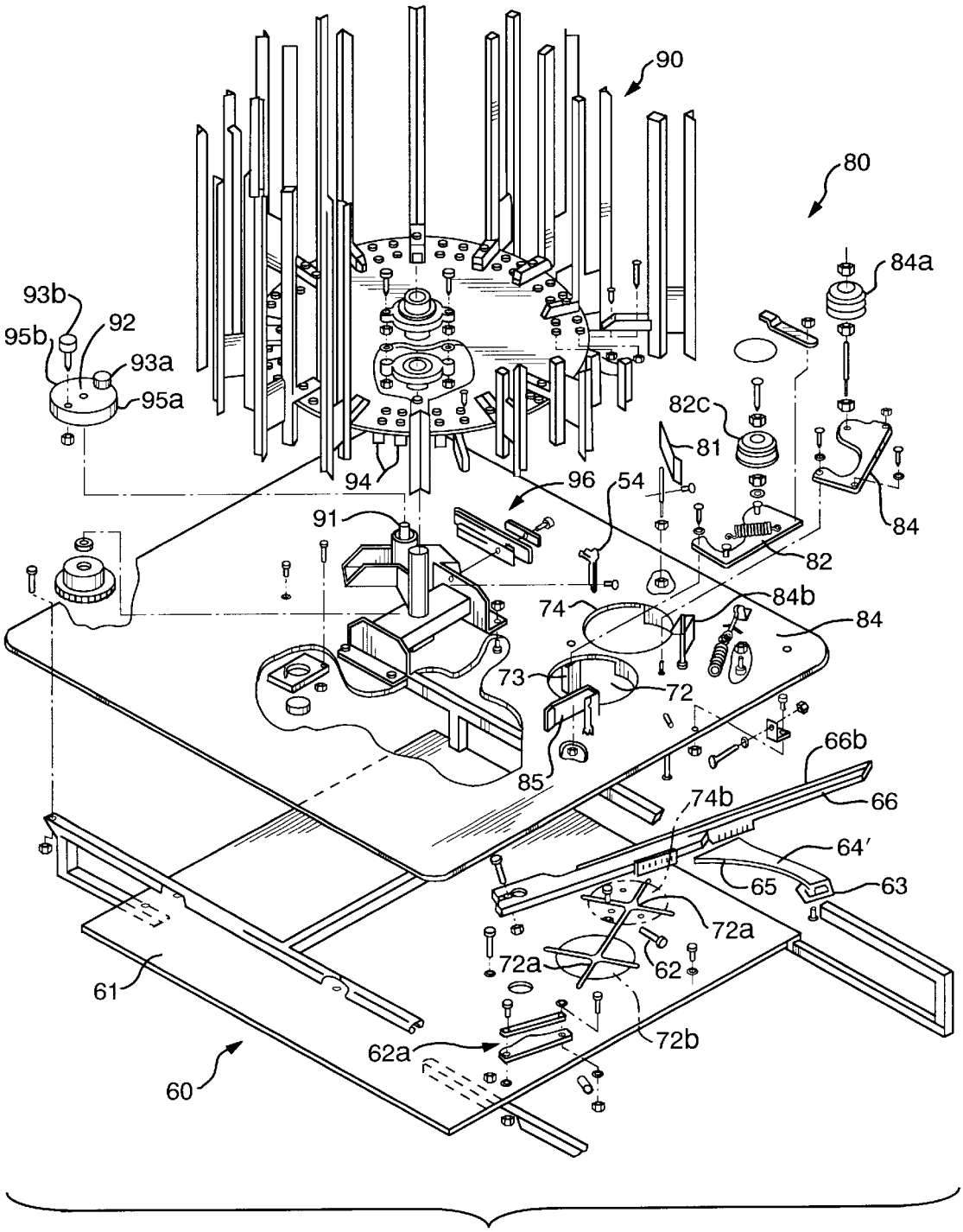
FIG. 6 is a mechanical drawing of the target positioning and launching assembly rigidly and functionally connected to the power system control assembly and the target holding and delivering assembly illustrating the functional interconnection between these two assemblies wherein the holding and delivering assembly is shown as an indexible turret which delivers targets for setting and which is tiltable, with all other basic assemblies except the base assembly with all of the major components and subassemblies in exploded view, including the improved doubles finger of the present invention.
Figure 7:
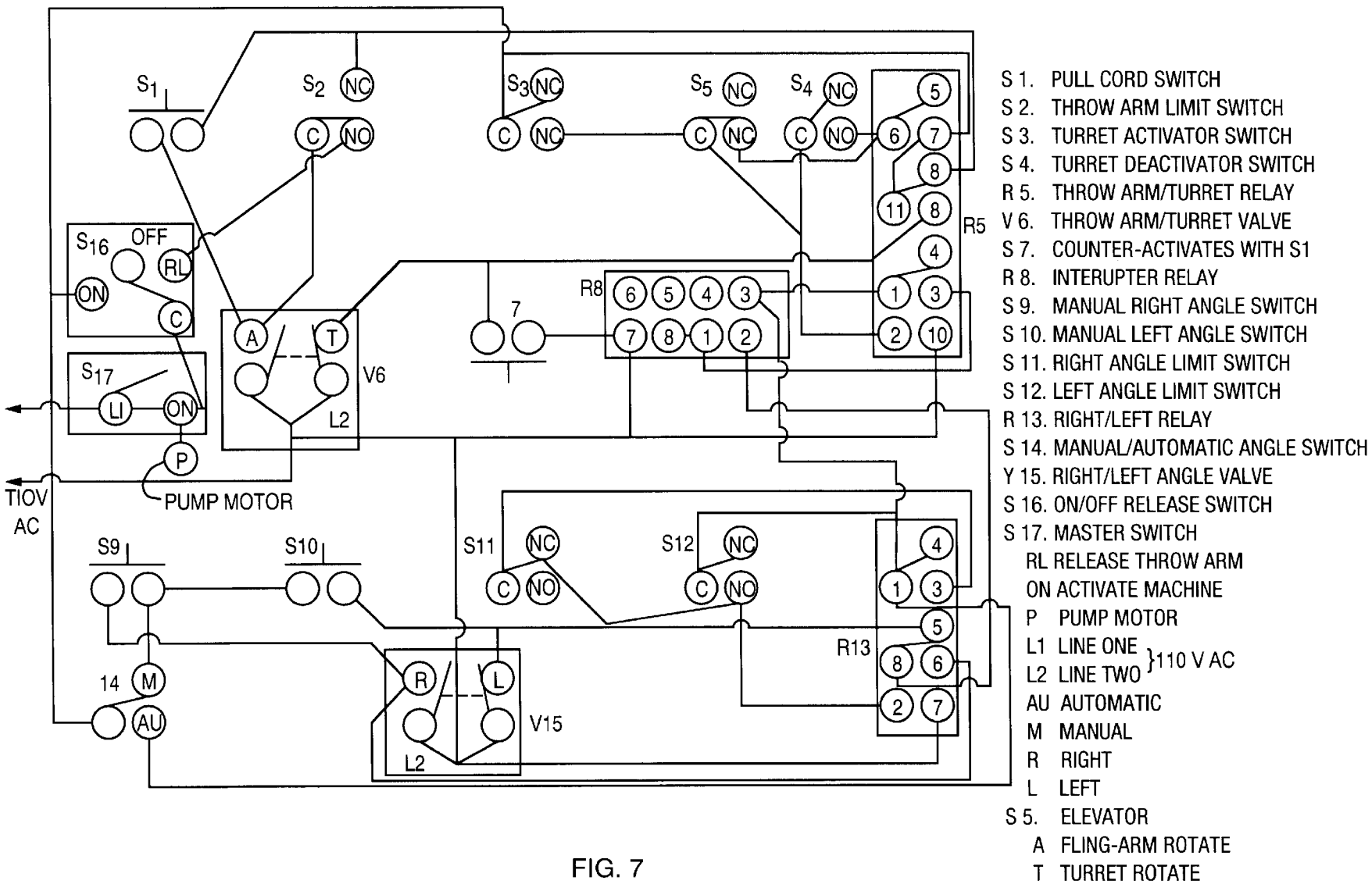
FIG. 7 is a basic wiring diagram which shows the point-to-point wiring between the various switches some of which are located on the power control box some positionally mounted on the machine as limit switches or flags to signal an amount of oscillatory excursion or the position of the fling-arm and the elevator along with the wiring of the relays (found in the electrical system box) and electrically actuated hydraulic valves associated with the hydraulic motor direction and amount of rotation of the motor along with control of the elevator and side-to-side action produced by the piston which causes the motion.

FIG. 2 is a pictorial illustration of machine 10 in association with pump 5 which provides the hydraulic pressure for operation of machine 10. Control assembly 8 illustrates how the operator controls the functions of machine 10. The hydraulic line assembly and connections are also pictorially illustrated in FIG. 2. A long control cord called a pull cord is connected at connector 8A. Such a control permits the launching of targets by the shooter or by another both of whom are generally and usually outside of the trap house.

The operation of machine 10 when throwing singles i.e., when only one clay target is being launched may be described with reference to installation instructions generally provided with machine 10. Additionally reference is made to the collections of drawing figures FIGS. 1–10 wherein like parts are identified with like numbers.

Having made all of the proper hydraulic connections and with power supplied to machine 10 by appropriately connecting to a source of electrical energy, hydraulic pump 5 is turned on using motor control switch S17 located on control box 8B. Switch S16 on control box 8B is set to the on position after S17 is turned on. The RELEASE position of switch S16 when activated will cause machine 10 to throw any target or targets that may be in the launch position and NOT reload the spring 67 which provides the energy to fling-arm 66. With some targets 2 placed into turret 90 and with angle control handle 14A in the down position (which position effectively allows flow of hydraulic fluid into oscillation cylinder 12) and with doubles roller 84A in singles orientation and in the singles setting of spring 67 (spring tension control crank 68 turned clockwise so that spring 67 is in the singles mode tension setting) the shooter provides a signal via actuation of a "PULL" button S1 on the pull cord connected to connector 8A. The fling-arm 66 is thereby caused to release from the position which was not quite at top dead center (this position is sensed by switch S2) and when the fling-arm 66 is advanced to the top dead center position as a result of activation of S1 or by actuating S16 to the RELEASE position causing motor 34 to rotate fling-arm 66 past top dead center, spring 67 releases its stored energy into rotational energy to fling-arm 66. After release of fling arm 66 by use of S1, hydraulic motor 34 is caused to rotate in a direction so as to advance turret 90 one indexed position which advances or delivers one clay target 2A to position 72. First or singles target holding assembly 82 along with singles roller 82C holds the targets above the singles aperture i.e., the position 72 from which the lower most target 2, i.e., 2A will be lowered by elevator 70 to set position 72A. Target holding assembly 82 along with single roller 82C prevents more than one target from being lowered by the elevator 70. The elevator 70 rises to position 72 substantially concurrently with the indexing of turret 90 so that the elevator 70 will be in proper position to accept first target 2A for lowering to the singles mode or the first target set position 72A. Upon target 2A being placed in the set position 72A fling-arm 66 is being gradually and slowly rotated toward the fully cocked position and at the same time target 2A is moved by the fling-arm 66 into launch position 72B which position is determined by singles finger 62 and the leading edge 66B of fling-arm 66 where target 2A is held by brush 73 and leading edge 66B of arm 66. When the fire of pull signal is generated by S1 hydraulic motor 34 causes a further rotation of fling-arm 66 to the extent that spring 67 releases and causes arm 66 to rotate with rapid acceleration launching target 2A on trajectory determined by the position of oscillation piston 12 and the tilt adjustment assembly 51. With handle 14A in the down or open position cylinder 14 in combination with cylinder 12 causes a slower acceleration and deceleration of the horizontal or oscillation motion of the machine 10 above base assembly 20. The assembly of cylinders 14 and 12 also permit settable speeds of motion in each of the directions-right and left-further adding to the randomness and the lack of predictability of the direction at which the target or targets will emerge.

In the doubles mode of operation roller 84*a* is simply flipped over so that by its design, a second target 2B will deposit or be delivered to elevator 70 in position 74. As elevator 70 is lowered by cylinder 71 target 2B is set into set position 74A. As arm 66, moves forward with the leading edge 66B contacting both targets 2A and 2B, they are both caused to softly come together at the urging of arm 66, guidance of singles finger 62 and finally improved doubles finger 64' into or to the launch positions 72B and 74B. On signal, flingarm 66 is released launching both targets 2A and 2B in trajectories which will be substantially the same relative to each other each time doubles are launched.

The singles holding spring 85 and spring 81 are of such a nature as to apply pressure on the edges of targets 2 which are in the turret 90 so that they do not jam or go out of position just after passing by position 72 and 74 respectively. Doubles spring 84B has a geometry which permits the sequential lowering of targets 2 which are stacked on turret 90 to be released one at a time as the turret 90 indexes or passes stacks of targets from position 74 toward position 72. The angle of the contacting edge, the edge which last contacts passing targets, is such that the bottom most target will release prior to passing too far toward position 72. If the bottom target, which will be set into position 72A, does not release timely it may tip into the aperture defined as position 72 and consequently break or jam the machine 10. Spring assemblies 84 are provided so that the pressure exerted by both the single roller 82C and the doubles roller 84A against the edge of the targets may be adjusted.

Turret 90 is indexed one position at a time with each 180° of rotation indexing shaft 91 which in turn rotates indexing wheel 92. The followers 93A and 93B alternatively, with each 180° of rotation, engage consecutive and adjacent follower bar pairs 94 causing the turret 90 to index to the next position while accelerating slowly at the start and the finish of the indexing action. Notches 95A and 95B engage the turret latch 96 and at the same time activate the turret stop switch S4.

More specifically, the present, improved doubles finger 64' may be incorporated into conventional trap throwing machines and may be incorporated into the trap throwing machine as described above. In operation, the doubles finger 64' guides the two targets in an accurate and reproducible, desirable trajectory.

The preferred embodiment of the invention is an improved doubles throwing finger 64', for use with clay target throwing apparati, and which can throw one or two targets 2 with more consistency and accuracy than conventional target throwing fingers. The improved doubles finger 64' of the present invention comprises a finger having a total length dimension of about 5 to 12 inches and preferably about 8¼ inches. It should be noted again that the length will be somewhat dependent upon the size of the trap machine with which it is or will be used. There is a target guide portion having a target contacting and guiding edge 65 which is arcuate and optionally radiused. The arced target contacting and guiding edge 65 has a length dimension which extends the length of the improved doubles finger 64'. The curvature of the arcuate target contacting and guiding edge may be preferably about equal to the curvature of an arc formed by a curved path made by the fling-arm of a clay target throwing machine as the fling-arm launches a first clay target and a second clay target.

There may also be provided an optional means for imparting enhanced rotational motion to a clay target 2 contacting the clay target contacting and guiding edge 65 which provides performance advantages over any of the known trap machines which throw two clay targets. The optional means for imparting enhanced rotational motion may be, for example, serations 65A along target contacting and guiding edge 65, or may be a variation of the angle or slope of target contacting and guiding edge 65 relative to the flat upper 69*a* and lower 69*b* surfaces of doubles finger 64', or it may also be a rubber-like or rubberized type material 65B coating target contacting and guiding edge 65. The various means for imparting enhanced rotational motion affect the rotational velocity of each of targets 2 as they pass along flinger arm 66 and target contacting and guiding edge 65 of doubles finger 64'. The length of doubles finger 64' and the are of target contacting and guiding edge 65 depend on the desired trajectory for the target or targets to be launched. For example, a somewhat shorter finger with a more tightly curved target contacting and guiding edge would yield a different trajectory than a longer finger with a more open curve of the target contacting and guiding edge. Differently sized and shaped fingers may be manufactured to be adapted to different clay target throwing machines for the desired flight characteristics of clay targets.

The doubles finger 64' also has a means 63 for rotatably and removably attaching finger 64' to a clay target throwing machine. For example, to attach doubles finger 64' to launch plate 61 of launching assembly 60 of the trap machine 10 means 63 for attaching may be an aperture in the attachment portion, through which a screw or the like may be placed for attachment of the doubles finger to the trap machine.

Figure 8:
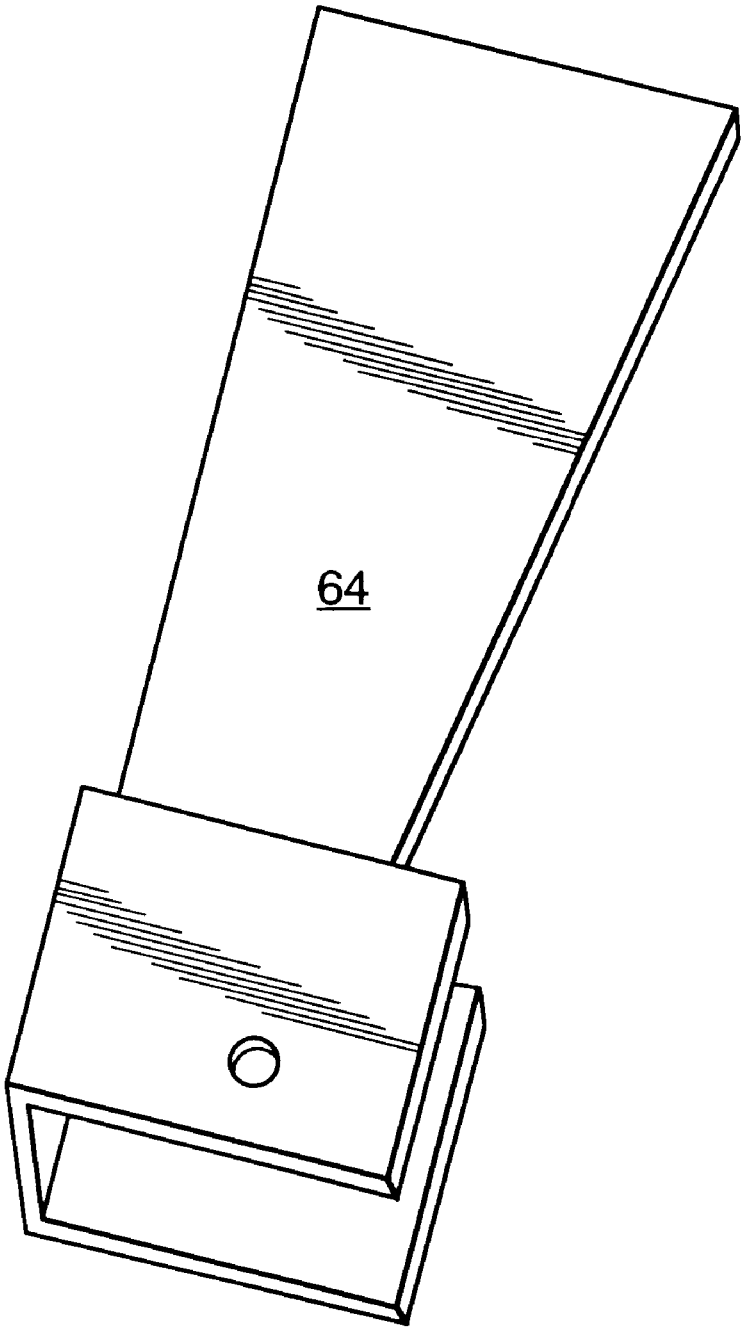
FIG. 8 (PRIOR ART)
FIG. 8 is bottom perspective view of a prior art throwing finger showing the straight, flat target contacting and guiding edge.
Figure 9:
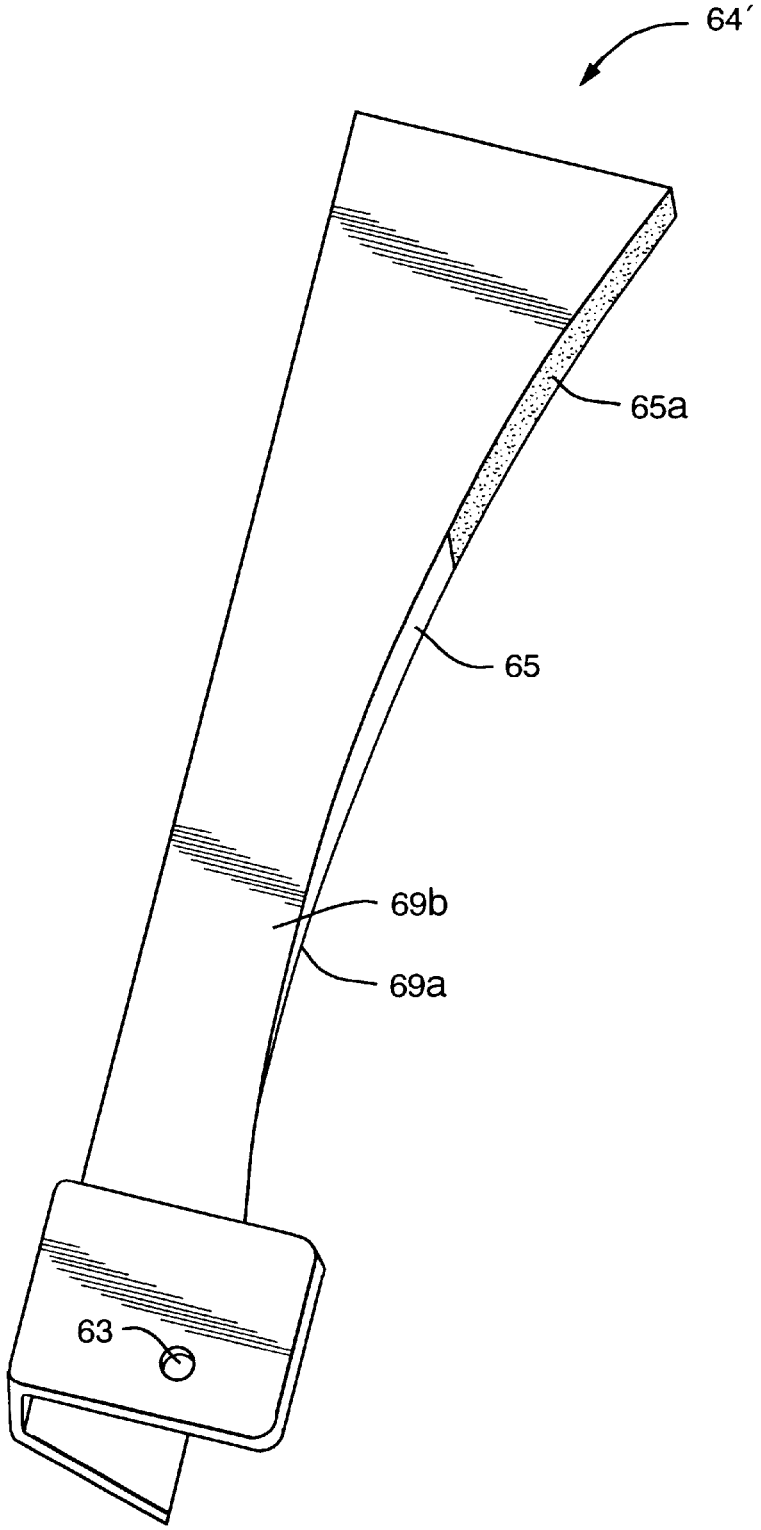
FIG. 9 is a bottom perspective view of the improved finger of the present invention showing the arcuate target contacting and guiding edge which extends the length of the doubles finger.
Figure 10:
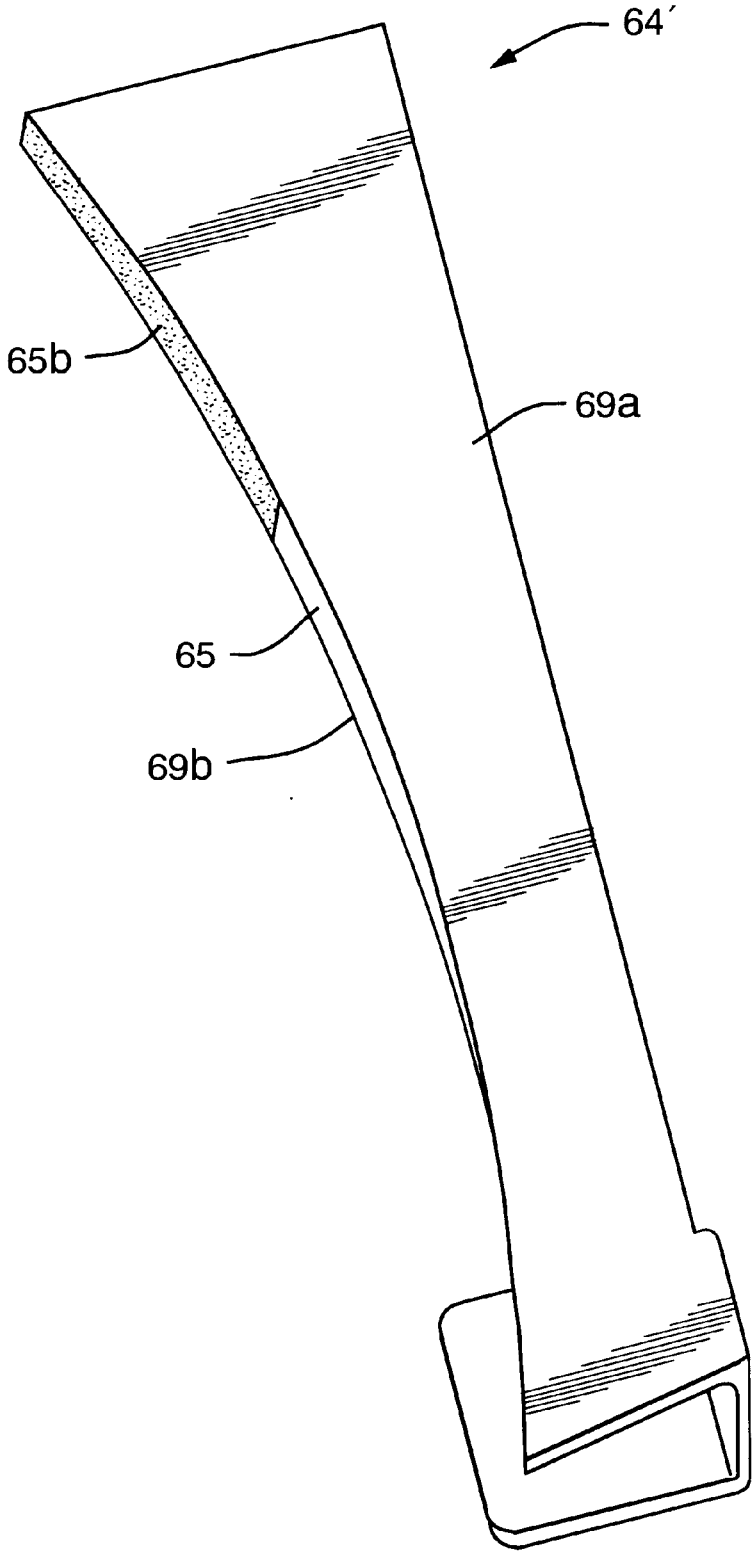
FIG. 10 is a top perspective view of the improved finger of the present invention also showing the arcuate target contacting and guiding edge which extends the length of the doubles finger.

With conventional doubles fingers, such as the one shown in FIG. 8, the outermost target trajectory commonly tails off to the right to some degree after launch. Use of the doubles finger of the present invention substantially prevents any tail off or deviation from the desired trajectory. Using improved doubles finger 64', the trajectory of the targets is accurately determined, and is very reproducible for each release of targets. Thus, the present doubles finger 64' is highly desirable in trap shooting competitions where it is important to have the targets thrown in consistent and similar trajectories.

Figure 11:
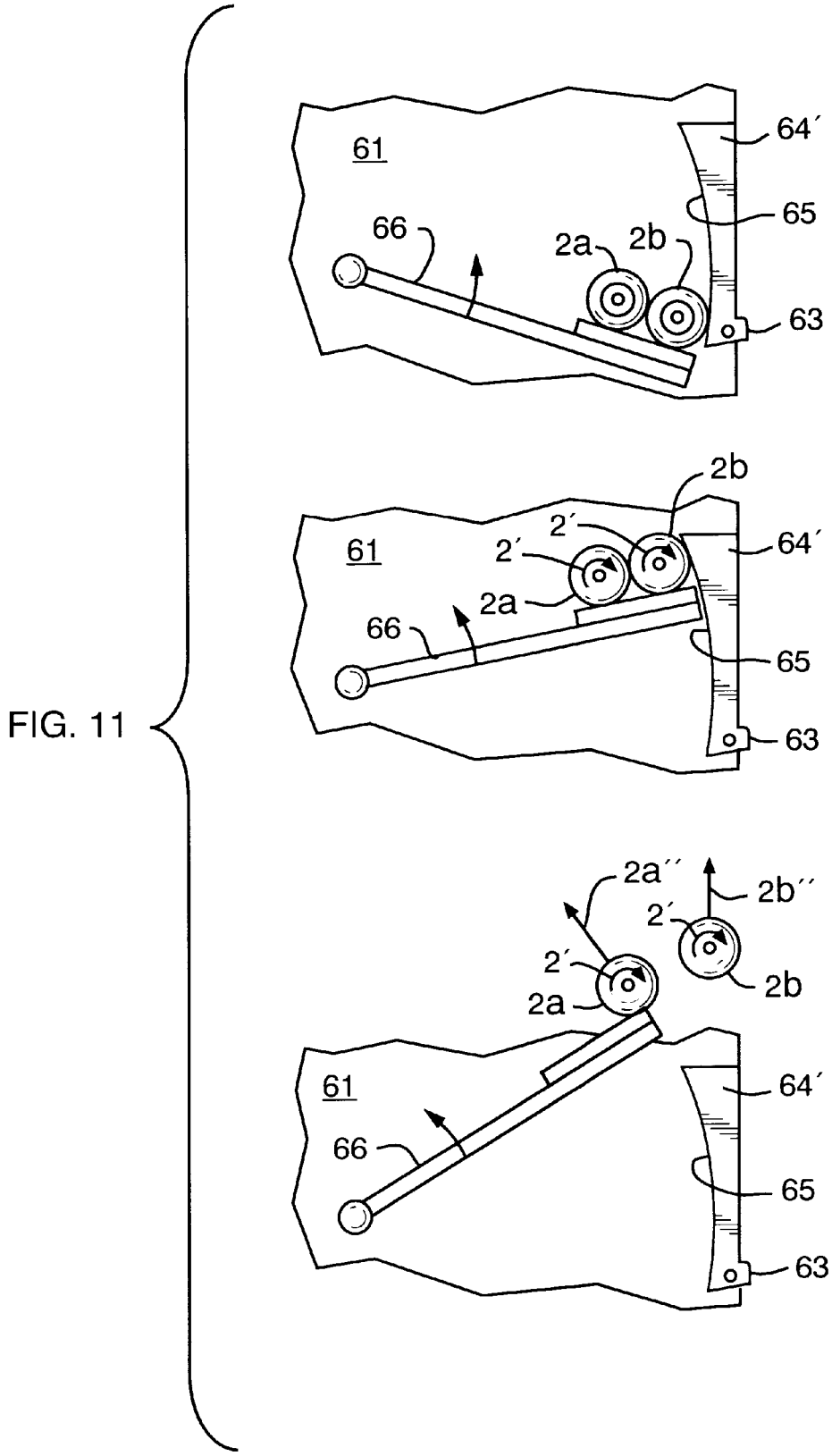
FIG. 11 is a time sequence illustration of the launch of two targets.

With reference to FIG. 11, which illustrates the launching of two targets in a sequence of views, the clay targets 2, the outermost target 2B and the inner target 2A, are shown in the rest position ready for launching. Target 2B is against fling arm 66 and against edge 65. Target 2A is contacting arm 66 and the edge of target 2B. The second time-lapse view illustrates targets 2 during acceleration of arm 66 and target 2B at about the end of edge 65. The acceleration of arm 66 in combination with contact with edge 65 causes both targets 2 to acquire a rotation 2'. In the third time-lapse view, target 2B has cleared edge 65 and has a trajectory indicated by vector 2B". Target 2A is about to clear fling arm 66 and has a trajectory 2A". Rotation 2' can be altered, at least in part, by making edge 65 more frictionous thereby imparting greater rotation to both targets 2 and consequently altering trajectories 2A" and 2B". Altering the length and the curvature of improved doubles finger 64' also will affect trajectories 2A" and 2B". It is further understood that by keeping targets 2 in contact with arm 66 for a longer period of time (relative to the time of contact for prior art fingers), due to the length of edge 65, targets 2 are subject to the acceleration forces of arm 66 for such a longer period of time. Further, because of the extended period of contact and the angular component created in the target trajectories as a consequence of the arcuate geometry of edge 65 and the angular velocity of arm 66, targets 2A and 2B acquire the most desireable trajectories 2A" and 2B". Clearly then, changing the length and/or the geometry of edge 65 consequently changes the time of contact of the targets 2 with arm 66 and thus the flight characteristics, i.e., the trajectories.

The components which have not been identified in the description of the preferred embodiment are clearly obvious to those of ordinary skill as to the identity and the function of the component. The components which make up much of the support structure, the gears which function and types are clear chains, drive belts and the like used to transmit the rotational energy to the various assemblies of the invention have not been elaborated upon again because all of such detail is obvious to any ordinarily skilled person.

It is thought that the improved doubles finger and many of its attendant advantages is understood from the foregoing description and it will be apparent that various changes may be made in the form, geometry, construction and arrangement of the parts thereof without departing from the spirit and scope of the invention or sacrificing all of its material advantages, the forms hereinbefore described being merely preferred or exemplary embodiments thereof.

I claim:

1. A doubles finger for use in a clay target throwing machine or trap machine comprising:

means for attaching said doubles finger to said clay target throwing machine;

a target guide portion contiguous with said means for attaching, said target guide portion having an arcuate target contacting and guiding edge positioned to contact a second clay target of two clay targets while said second clay target is being launched by said clay target throwing machine when said doubles finger is assembled onto said clay target throwing machine; and said arcuate target contacting and guiding edge having a defined and predetermined length.

2. The doubles finger of claim 1 wherein the curvature of said arcuate target contacting and guiding edge of said doubles finger is chosen to give a desired first target trajectory, second target trajectory, first target velocity and second target velocity.

3. The doubles finger of claim 2 wherein said curvature of said arcuate target contacting and guiding edge is about equal to the curvature of an arc formed by a curved path made by a fling-arm of said clay target throwing machine as said fling-arm launches said first clay target and said second clay target.

4. The doubles finger of claim 2 wherein said length of said target contacting and guiding edge is chosen such that said first target trajectory, said second target trajectory, said first target velocity, and said second target velocity are variable depending on said curvature of said target contacting and guiding edge and depending on said length of said target contacting and guiding edge.

5. The doubles finger of claim 1 wherein said defined and predetermined length of said target contacting and guiding edge is chosen to yield a desired first target trajectory, second target trajectory, first target velocity and second target velocity and wherein said means for attaching further comprises means for removably, and rotatably adjustably attaching said doubles finger to said clay target throwing machine.

6. The doubles finger of claim 1 further comprising: means for imparting enhanced rotational motion to said first clay target and said second clay target.

7. The doubles finger of claim 6 wherein said means for imparting enhanced rotational motion comprises serations cut along at least a portion of the length of said target contacting and guiding edge.

8. The doubles finger of claim 6 wherein said means for imparting enhanced rotational motion comprises a frictionous material secured along at least a portion of the length of said target contacting and guiding edge and wherein said means for attaching further comprises means for removably, and rotatably adjustably attaching said doubles finger to said clay target throwing machine.

9. The doubles finger of claim 1 wherein said means for attaching further comprises means for removably, and rotatably adjustably attaching said doubles finger to said clay target throwing machine.

10. In an improved clay target throwing machine having a means for holding and for delivering a first clay target to a position for subsequent setting, means for setting said first target into a position for launching, means for launching by a single cocked fling-arm said first target into a target area, means for selecting constant and random first trajectories of said launched first target into said target area and means for switchably providing power, upon occurrence of a signal, to said means for holding and delivering of said first target and cocking said single fling-arm, means for selectively delivering, by lowering, two targets substantially simultaneously, said first target to a first target set position and a second target to a second target set position, and means for substantially simultaneously setting, by said single fling arm moving into said cocked position, said first target and said second, when said two target delivery is selected, target into a first and second launch position and holding each said first target and said second target in said first and second launch positions prior to launching of said first target and said second target, said first launch position and said launch position being defined such that said single fling-arm contacts substantially congruent tangents of each said first target and said second target and both first target and said second target in contact at a common tangent of a target edge of each said first target and said second target, said congruent tangent and said common tangent being substantially orthogonal each to the other, said first launch position and said second launch position thus relative to each other so as to reduce target breakage and relative to said single fling-arm for proper launching of said first target into said first target trajectory and simultaneously launching said second target into a second target trajectory, said improvement comprising:

a doubles finger comprising:

means for attaching said doubles finger to said clay target throwing machine;

a target guide portion contiguous with said means for attaching, said target guide portion having an arcuate target contacting and guiding edge positioned to contact said second clay target of two clay targets while said second clay target is being launched by said clay target throwing machine when said doubles finger is assembled onto said clay target throwing machine; and said arcuate target contacting and guiding edge having a defined and predetermined length said doubles finger thereby configured to cause said first target and said second target each to have an optimum, consistent, reproducible and desirable first target trajectory, second target trajectory, first target velocity and second target velocity.

11. The improved clay target throwing machine according to claim 10 further comprising:

means for measurably and repeatably adjusting an amount of energy in said single cocked fling-arm thereby controlling a length measure of said first trajectory and second trajectory; and means for adjusting said doubles finger thereby causing a relative change in said second trajectory of said second launched target relative to said first trajectory of said first launched target; and wherein the curvature of said arcuate target contacting and guiding edge of each said doubles finger is chosen to give a desired first target trajectory, second target trajectory, first target velocity and second target velocity.

12. The improved clay target throwing machine according to claim 11 further comprising means for controlling a rate of acceleration and a rate of deceleration of said means for holding and delivering of said first target and of said two targets when said two target delivery is selected; and wherein said curvature of said arcuate target contacting and guiding edge is about equal to the curvature of an arc formed by a curved path made by a fling-arm of said clay target throwing machine as said fling-arm launches said first clay target and said second clay target.

13. The improved clay target throwing machine according to claim 12 further comprising means for lowering of said first target, and of said two targets when said two target delivery is selected, from said position for subsequent setting to said first target set position and to said second target set position for subsequent movement to said first launch position and said second launch position, and wherein said defined and predetermined length of said target contacting and guiding edge is chosen to yield a desired first target trajectory, second target trajectory, first target velocity and second target velocity and wherein said means for attaching further comprises means for removably, and rotatably adjustably attaching said doubles finger to said clay target throwing machine.

14. The improved clay target throwing machine according to claim 13 wherein said means for holding and said means for selectively delivering further comprises:

a rotationally indexable turret assembly capable of holding and sequentially delivering at least four cases of said clay targets, each said case having 135 clay targets therein;

means for rotationally indexing said turret assembly, said means for rotationally indexing causing said turret assembly to index said first target and said two targets simultaneously, when said two target delivery is selected, to said first launch position and said second launch position; and means for rotationally driving said means for rotationally indexing said turret assembly such that for each 180° of rotation of said means for rotationally driving, said first target and said two targets are simultaneously delivered, when said two target delivery is selected; and wherein said doubles finger further comprises:

means for imparting enhanced rotational motion to said first clay target and said second clay target, wherein said means for imparting enhanced rotational motion is selected from the group consisting of serations and frictionous material on said target contacting and guiding edge.

15. A clay target throwing machine or trap machine for selectively propelling a first clay target or, simultaneously a first clay target and a second clay target comprising:

a base assembly which is substantially stationary relative to a surface upon which said machine rests;

a power system control assembly tiltably, rotationally and oscillatorially interconnected to said base assembly;

a target positioning and launching assembly rigidly and functionally connected to said power system control assembly having means for launching, by a single cocked fling-arm, said first target into a first target trajectory, and simultaneously launching said second target into a second target trajectory, means for holding and delivering said first target to a first target set position and said second target to a second target set position for subsequent setting, by said single fling-arm moving into a cocked position, to said first launch position and said second launch position and means for subsequent setting and positioning for launch said first clay target and both said first and said second clay targets simultaneously into said first launch position and said second launch position when said first target and second target are delivered to a position for subsequent setting;

a doubles finger positioned on said target positioning and launching assembly, said doubles finger comprising:

means for attaching said doubles finger to said clay target throwing machine;

a target guide portion contiguous with said means for attaching, said target guide portion having an arcuate target contacting and guiding edge positioned to contact said second clay target of two clay targets while said second clay target is being launched by said clay target throwing machine when said doubles finger is assembled onto said clay target throwing machine; and said arcuate target contacting and guiding edge having a defined and predetermined length, said doubles finger thereby configured to cause said first target and said second target each to have an optimum, consistent, reproducible and desirable first target trajectory, second target trajectory, first target velocity and second target velocity; and a target holding and delivering assembly for holding a plurality of said clay targets and when driven by means for driving said target holding and delivering assembly, delivering selectively, a first clay target to a first setting position for subsequent setting and simultaneously delivering both said first clay target and said second clay target into positions for simultaneously setting of said first clay target and said second clay target into a first launch position and a second launch position respectively on a launch plate of said launching assembly when said two target delivery is selected.

16. The clay target throwing machine according to claim 15 wherein said holding and delivering assembly is a turret which holds a plurality of said clay targets and said turret, when driven by means for rotationally indexing said plurality of clay targets, rotationally indexes relative to said target positioning and launching assembly, on signal, appropriately moving one and two clay targets into said position for subsequent setting and positioning for launch.

17. The clay target throwing machine according to claim 16 further comprising means for measurably and repeatably adjusting an amount of energy in said single cocked fling-arm thereby controlling a length measure of said first trajectory and second trajectory; and means for adjusting said doubles finger thereby causing a relative change in said second trajectory of said second target relative to said first trajectory of said first target.

18. The clay target throwing machine according to claim 17 further comprising means for limiting a rate of acceleration and a rate of deceleration of said means for holding and delivering of said first target and of said first target and second target when said two target delivery is selected.

19. The clay target throwing machine according to claim 18 further comprising means for lowering of said first target, and of said first target and said second target when said two target delivery is selected, from said position for subsequent setting to said first target set position and to said second target set position for subsequent movement to said first launch position and said second launch position.

* * * * *